US006096666A

United States Patent [19]

Jachimowicz et al.

[11] Patent Number: 6,096,666

[45] **Date of Patent: *Aug. 1, 2000**

[54] HOLOGRAPHIC TEXTILE FIBER

[75] Inventors: Karen E. Jachimowicz, Laveen; Michael S. Lebby, Apache Junction, both of Ariz.

[73] Assignee: Motorola, Inc., Schaumburg, Ill.

[ * ] Notice: This patent is subject to a terminal disclaimer.

[21] Appl. No.: 09/069,590

[22] Filed: Apr. 29, 1998

[51] Int. Cl.[7] ..... D03D 15/08; D02G 3/00

[52] U.S. Cl. ..... 442/188; 428/378; 428/379; 139/420 R

[58] Field of Search ..... 428/365, 378, 428/379; 139/420 R; 442/188

[56] References Cited

U.S. PATENT DOCUMENTS 5,354,294 10/1994 Chou ..... 606/16
5,498,260 3/1996 Rink et al. ..... 606/16
5,906,004 5/1999 Lebby et al. ..... 2/1

*Primary Examiner*—Christopher Raimund
*Attorney, Agent, or Firm*—Eugene A. Parsons; William E. Koch

[57] ABSTRACT

A holographic textile fiber that selectively absorbs and reflects different wavelengths of light. A plurality of holographic textile fibers in combination forming a holographic textile fabric. The plurality of textile fibers characterized as including a central core including one of a light transmitting material, a light absorbing material, a light reflecting material, or a polymer dispersed liquid crystal (PDLC) material. The holographic textile fibers further including a plurality of layers of an optical media. Each of the plurality of layers having differing indices of refraction thereby forming a multi-layer interference coating overcoating the central core. The plurality of layers of optical media characterized as selectively reflecting particular wavelengths of light while transmitting differing wavelengths of light, thereby generating a plurality of interference patterns that form a holographic optical image as a result of an incident light.

25 Claims, 2 Drawing Sheets

-PRIOR ART-

HOLOGRAPHIC TEXTILE FIBER

FIELD OF THE INVENTION

This invention relates, in general, to textile fibers and, more particularly, to textile fibers that selectively absorb or reflect different wavelengths of light.

BACKGROUND OF THE INVENTION

Three dimensional images made holographically, called holograms, are becoming quite prevalent these days. A hologram is essentially a material composed of a plurality of layers of varying indices of refraction. These layers are designed or created such that they cause light to interfere, creating an interference pattern which forms a three-dimensional image in space.

Initially holograms were very carefully and expensively created with lasers and air-suspension tables, a process that required lasers for the holograms to be viewed as well as fabricated. These original holograms were very expensive to create and are now housed in museums. Holograms which could be read with white light made the hologram something everyone could enjoy in that a laser was no longer needed for viewing. With the advent of computer designed and fabricated white light holograms, the fabrication process was made inexpensive. White light holograms are now prevalent forms of art and color. They are commonly found on toys and cereal boxes. Active holograms are now being manufactured by fabricating some of the layers from liquid crystal materials, or other materials which can be made to alter their index of refraction by applying a voltage, or some other means.

Clothes have always been to some extent a form of art, combining color and functionality. Color is given to fabric, and to the resulting clothes, by dying the textile fibers. A dye is basically a selective absorber. The color that the clothes appears to the eye, depends on which wavelengths the fabric absorbs and which wavelengths it reflects. For example, a red fabric reflects red wavelengths and absorbs others.

By using the principles of holography and light interference and applying them to fibers that are made into fabric, clothes can be fabricated which obtain their color properties from the interference of light, instead of solely from light absorption properties. This can provide new options for colors in fabrics. By adding the option of active layers, the fibers can be fabricated to change their interference properties. By careful design these active holographic textile fibers can be fabricated into resulting displays, or other active imagery in the fabric and clothes.

Thus, it would be highly desirable to provide for a holographic textile fiber for use in fabric, clothing, or the like.

Accordingly, a holographic textile fiber that provides for the selective absorption and reflection of different wavelengths of light would be highly advantageous.

It is a purpose of the present invention to provide for a new and improved holographic textile fiber that selectively absorbs and reflects different wavelengths of light dependent upon the specific indices of refraction contained in the fiber.

It is a further purpose of the present invention to provide for a holographic textile fiber that is fabricated to include a central core and a plurality of layers of optical media, forming a multi-layer interference coating, resulting in a plurality of interference patterns.

It is a still further purpose of the present invention to provide a new and improved holographic textile fiber that is passive, thus stable so as to always reflect the same particular wavelength of light, which corresponds to a particular color of light, due to stable indices of refraction.

It is yet a further purpose of the present invention to provide for a new and improved holographic textile fiber that is active, thus capable of changing the wavelengths and corresponding color of light reflected, due to a change in the indices of refraction under the influence of a external voltage.

It is a still further purpose of the present invention to provide for a new and improved holographic textile fabric, including a plurality of holographic textile fibers, that in combination generate varying interference patterns resulting in varying colors, patterns and images.

SUMMARY OF THE INVENTION

Briefly stated, provided is a textile fiber that selectively absorbs and reflects different wavelengths of light, using the interference properties of light to accomplish this. A plurality of these textile fibers in combination form a holographic textile fabric. The plurality of textile fibers are characterized as including a central core and a plurality of layers of an optical media overcoating the central core. A plurality of interference patterns are created as a result of an incident light upon the plurality of holographic fibers, that in combination form colors, patterns and images.

BRIEF DESCRIPTION OF THE DRAWINGS

The novel features believed characteristic of the invention are set forth in the claims. The invention itself, however, as well as other features and advantages thereof will be best understood by reference to detailed descriptions which follow, when read in conjunction with the accompanying drawings, wherein:

DETAILED DESCRIPTION OF THE DRAWINGS

Holographic textile fibers can be utilized as clothing fibers that selectively absorb or reflect different wavelengths of light using layers of transparent optical media with differing indices of refraction. When these layers of differing indices of refraction are positioned correctly with respect to incident light, colors, patterns and images are formed by the resulting interference patterns. This is standard in holograms and multi-layer interference coatings. Holograms use patterns of varying index of refraction to create an interference pattern which replicates an object and forms a three-dimensional image. Multi-layer interference coatings are designed to selectively reflect a particular band of wavelengths, while transmitting others. When utilizing a plurality of these holographic optical fibers to form a holographic textile fabric, the resulting interference patterns of the plurality of holographic textile fibers form varying colors, patterns, and images, and thus can be utilized to form displays in textile fabrics, more particularly in clothing.

Figure 1:
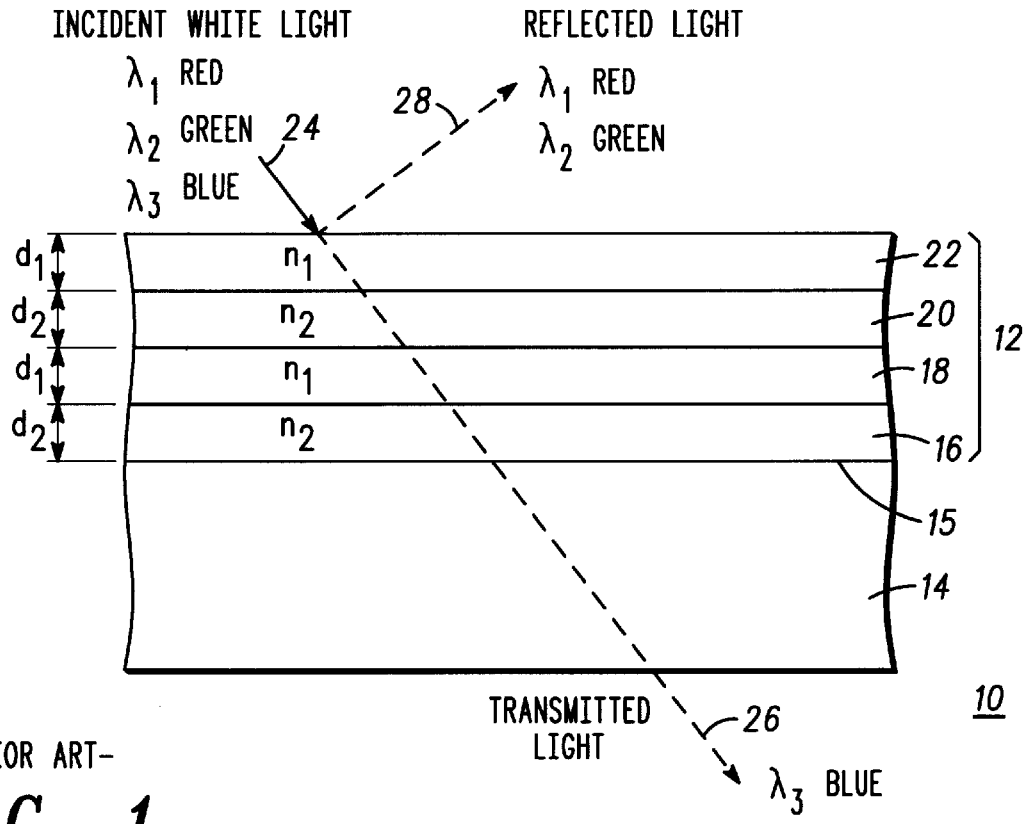
FIG. 1 is cross-sectional view of a prior art multi-layer interference coating filter device.

Referring now to FIG. 1 illustrated is a prior art multi-layer filter device 10, including a multi-layer interference coating 12 formed on a glass substrate 14. As illustrated, multi-layer interference coating 12 includes a first layer 16 having an index of refraction of $n_2$ and a thickness of $d_2$, a second layer 18 having an index of refraction of $n_1$ and a thickness of $d_1$, a third layer 20 having an index of refraction of $n_2$ and a thickness of $d_2$ and a fourth layer 22 having an index of refraction of $n_1$ and a thickness of $d_1$. In this particular example, device 10 is designed where an incident light 24 is composed of first wavelength, red light, second wavelength, green light and third wavelength blue light. Multi-layer interference coating 12 composed of layers 16, 18, 20 and 22 is deposited on an uppermost surface 15 of glass substrate 14. The indices of refraction, $n_1$ and $n_2$, and the thicknesses, $d_1$ and $d_2$, of multi-layer overcoating 12, composed of the plurality of layers of optical media, are chosen such that third wavelength, blue light 26 is transmitted and first wavelength, red light and second wavelength, green light, 28 are reflected. Accordingly, dependent upon the chosen indices of refraction and thickness of multi-layer overcoating 12, specific wavelengths of light will be transmitted and specific wavelengths of light will be reflected through filter device 10.

Figure 2:
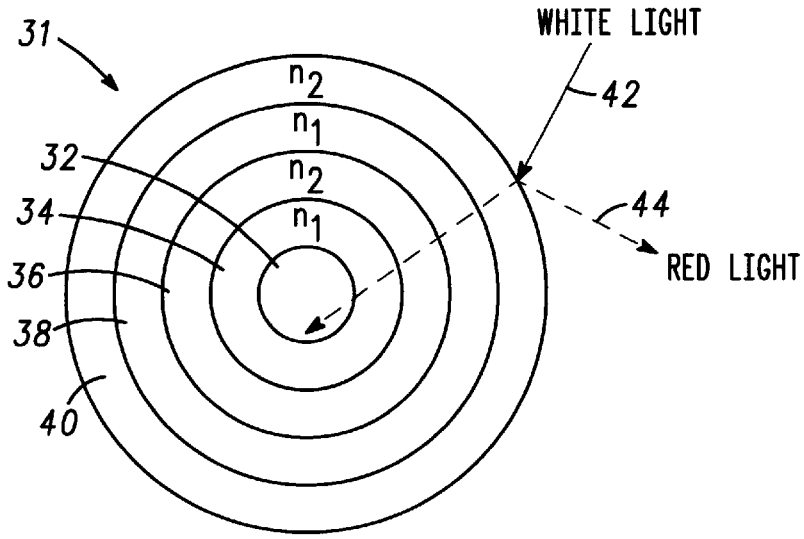
FIG. 2 is a cross-sectional view of a passive holographic fiber according to the present invention.

Referring now to FIG. 2, illustrated is a first embodiment of a holographic textile fiber according to the present invention. In this particular embodiment, holographic textile fiber, generally referenced as 30, is described as a passive holographic textile fiber. As illustrated, fiber 30 includes a light absorbing central core 32, surrounding by a plurality of layers of optical media material having varying indices of refraction, designated multi-layer overcoating 31. More particularly, fiber 30 includes light absorbing central core 32, such as a black thread, and a first layer of optical media 34 having an index of refraction of $n_1$, a second layer of optical media 36 having an index of refraction of $n_2$, a third layer of optical media 38 having an index of refraction of $n_1$ and a fourth layer of optical media 40 having an index of refraction of $n_2$. In general, when light absorbing central core 32 is composed of a black thread, the black thread consists of a plurality of threads, twisted so as to form a single thread. In keeping with this theory of a twisted black core thread, layers 34, 36, 38 and 40 can also be formed so as to twist around light absorbing central core 32, generally forming a single twisted textile fiber. It should be understood that central core 32 in an alternate embodiment includes either a light reflecting material or a light transmitting material. In this particular embodiment, a white light 42, including red, green and blue wavelength light, is incident on fiber 30. As illustrated, due to the varying indices of refraction of layers 34, 36, 38, and 40 a portion of incident light 42 is transmitted through layers 34, 36, 38 and 40 and is ultimately absorbed by absorbing core 32 and a portion of light 42, designated here as red wavelength light 44, is reflected by the multi-layer stack of optical media 31 on fiber 30. This reflection of red wavelength light 44 is seen as giving color to fiber 30. This fiber is described as being passive, in that there is no change in the index of refraction of the layers 34, 36, 38, and 40 thus fiber 30 always reflects the same wavelength of light and is thus always seen as one particular color. It should be understood that there can be greater or fewer layers than those shown in the preferred embodiments, more indices of refraction and differences in thicknesses depending on the particular wavelength of light to be reflected.

Figure 3:
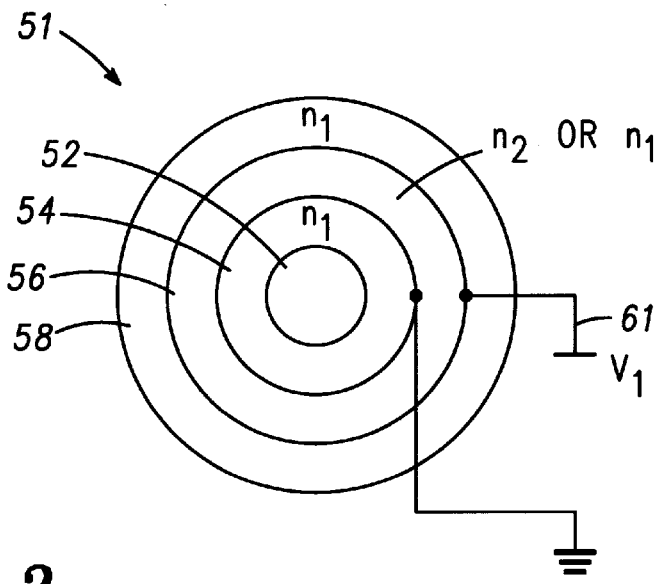
FIG. 3 is a cross-sectional view of an active holographic fiber according to the present invention.

Referring now to FIG. 3, illustrated is a holographic textile fiber 50, which in this particular embodiment is described as an active holographic fiber. Active holographic textile fiber 50, fabricated generally similar to fiber 30 of FIG. 2, includes a central core 52, generally described as light absorbing, and a multi-layer overcoating 52. Multi-layer overcoating 52 is formed of a first layer 54 having an index of refraction of $n_1$, a second layer, also referred to as an active optical layer, 56 having an index of refraction of $n_1$ or $n_2$, dependent upon a voltage applied thereto (described presently), and a third layer 58 having an index of refraction of $n_1$. More particularly, in this particular embodiment, one or more of the layers, 54, 56 or 58 is considered active under the influence of an external voltage 60. External voltage 60 is accomplished by fabricating a conducting layer at the inner and outer edge of layer 56. This conductive layer is connected to a variable voltage source $V_1$. An example of a material which would change its index of refraction under the influence of a voltage is a liquid crystal material. Thus under the influence of voltage 60, the index of refraction of active optical layer 56 is changed, thus changing the reflecting properties of fiber 50.

As an example, when voltage $V_1$ is "off", and layer 56 has an index of refraction of $n_1$, all light will be transmitted and absorbed by central core 52. When voltage $V_1$ is "on", and layer 56 has an index of refraction of $n_2$, light of a specific color will be reflected, thus fiber 50 when viewed will appear to be that specific color reflected. Fibers such as those described here as active fiber 50 can be interwoven into a textile fabric, such as into a pattern, etc., thus allowing specific colors, images and patterns to be formed, and permitting the use of the images as "displays". It should be understood that multi-layer overcoating 52 can include greater or fewer layers than those shown in the preferred embodiment, including greater or fewer active layers. In addition, the fiber can include more indices of refraction and differences in thicknesses depending on the particular wavelength of light to be reflected and with regard to a particular design to create a specific interference pattern and resulting color or image.

Figure 4:
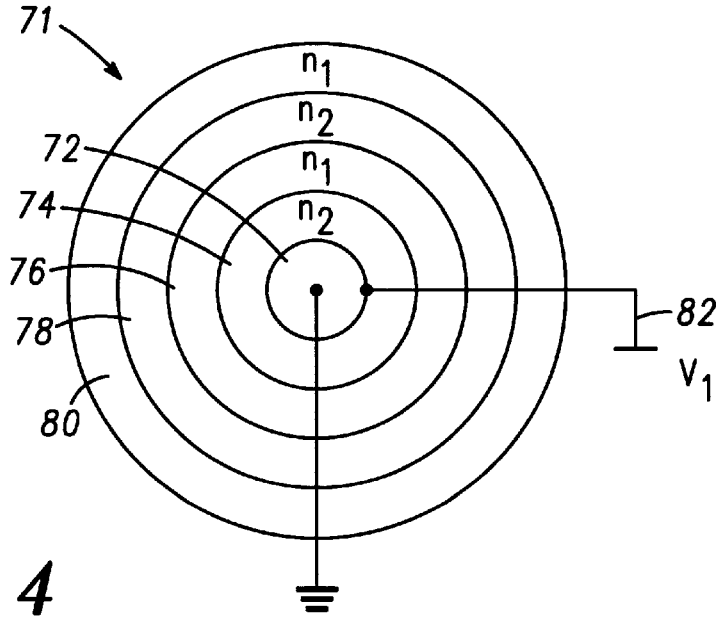
FIG. 4 is an alternate embodiment of an active holographic fiber including a polymer dispersed liquid crystal (PDLC) core material according to the present invention.

Referring now to FIG. 4, illustrated is a holographic textile fiber 70, which in this particular embodiment is also described as an active fiber. Holographic textile fiber 70, fabricated generally similar to fiber 30 of FIG. 2, includes a central core 72, and a multi-layer overcoating 71. Multi-layer overcoating 71 is formed of a first layer 74 having an index of refraction of $n_2$, a second layer 76 having an index of refraction of $n_1$, a third layer 78 having an index of refraction of $n_2$, and a fourth layer 80 having an index of refraction of $n_1$. In this particular embodiment, central core 72 is described as a being a polymer dispersed liquid crystal (PDLC) material, or other material which changes from transparent state to diffuse state under the influence of an external voltage 82.

More specifically, in this particular embodiment, fiber 70 is considered active under the influence of external voltage 82, due to the changing of optical properties of central core 72. More particularly, multi-layer overcoating 71 either selectively reflects certain wavelengths of light or transmits all wavelengths of light if $n_1=n_2$. Thus under the influence of voltage 82, which is carried by a conductive coating on the outside of central core 72 and a conducting core running down the middle of central core 72, and connected to a voltage source, fiber 70 changes from transmitting all light to reflecting all light or from reflecting one particular wavelength or color, to reflecting all light. Again, fibers such as those described here as active fiber 70 can be interwoven into a textile fabric, such as into a pattern, etc., thus allowing specific "displays" to be formed from the fabric.

Thus, described is a holographic textile fiber, that dependent upon specific fabrication can be described as an active fiber or a passive fiber. The fibers as described are intended for inclusion in a textile fabric so as to permit the formation of a holographic display. The display would be changeable dependent upon a voltage applied thereto when utilizing active holographic textile fibers.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A textile fiber comprising a central core and a plurality of layers of an optical media overcoating the central core, wherein an interference pattern is created as a result of an incident light.

2. A textile fiber as claimed in claim 1 wherein a plurality of textile fibers when fabricated to form a textile fabric, generate a plurality of interference patterns to form a holographic optical image.

3. A textile fiber as claimed in claim 1 wherein the central core of the textile fiber is a light absorbing material.

4. A textile fiber as claimed in claim 3 wherein the light absorbing material is a black thread.

5. A textile fiber as claimed in claim 1 wherein the central core of the textile fiber is a light transmitting material.

6. A textile fiber as claimed in claim 1 wherein the central core of the textile fiber is a light reflecting material.

7. A textile fiber as claimed in claim 1 wherein the central core of the textile fiber is a polymer dispersed liquid crystal (PDLC) material, characterized as changing from transparent state to a diffuse state under the influence of a voltage.

8. A textile fiber as claimed in claim 1 wherein the plurality of layers of an optical media include a plurality of layers having differing indices of refraction and forming a multi-layer interference coating designed to selectively reflect particular wavelengths of light while transmitting differing wavelengths of light.

9. A textile fiber as claimed in claim 8 wherein the textile fiber is characterized as an active holographic fiber.

10. A textile fiber as claimed in claim 9 wherein the active holographic fiber includes a voltage interfaced with one or more of the plurality of layers forming the multi-layer interference coating, wherein under the influence of the voltage, a change in an index of refraction of at least one of the layers of the multi-layer interference coating results, thereby altering the optical properties of the holographic fiber and forming an active optical layer.

11. A textile fiber as claimed in claim 10 wherein the optical properties of at least one of the layers of the multi-layer interference coating are altered from transmitting optical properties to absorbing optical properties.

12. A textile fiber as claimed in claim 10 wherein the optical properties of at least one of the layers of the multi-layer interference coating are altered from absorbing optical properties to transmitting optical properties.

13. A textile fiber as claimed in claim 10 wherein the optical properties of at least one of the layers of the multi-layer interference coating are altered from reflecting optical properties to transmitting optical properties.

14. A textile fiber as claimed in claim 10 wherein the optical properties of at least one of the layers of the multi-layer interference coating are altered from transmitting optical properties to reflecting optical properties.

15. A textile fiber as claimed in claim 10 wherein the active optical layer of the multi-layer interference coating includes a liquid crystal material.

16. A textile fiber as claimed in claim 8 wherein the textile fiber is characterized as a passive holographic fiber.

17. A textile fabric comprising:

a plurality of holographic fibers that selectively absorb and reflect different wavelengths of light, the plurality of holographic fibers characterized as including a central core and a plurality of layers of an optical media having differing indices of refraction thereby forming a multi-layer interference coating overcoating the central core, the plurality of layers of an optical media characterized as selectively reflecting particular wavelengths of light while transmitting differing wavelengths of light, thereby generating a plurality of interference patterns that form a holographic optical image as a result of an incident light.

18. A textile fabric as claimed in claim 17 wherein the central core of each of the plurality of holographic fibers is a light absorbing material.

19. A textile fabric as claimed in claim 17 wherein the central core of each of the plurality of holographic fibers is a light transmitting material.

20. A textile fabric as claimed in claim 17 wherein the central core of each of the plurality of holographic fibers is a light reflecting material.

21. A textile fabric as claimed in claim 17 wherein the central core of each of the plurality of holographic fibers is a polymer dispersed liquid crystal (PDLC) material, characterized as changing from transparent state to a diffuse state under the influence of a voltage.

22. A textile fabric as claimed in claim 17 wherein each of the plurality of holographic fibers is characterized as an active holographic fiber including a voltage interfaced with one or more of the plurality of layers forming the multi-layer interference coating, wherein under the influence of the voltage, a change in an index of refraction of the multi-layer interference coating results, thereby altering the optical properties of the holographic fiber.

23. A textile fabric as claimed in claim 17 wherein each of the plurality of holographic fibers is characterized as a passive holographic fiber.

24. A textile fabric comprising:

a plurality of holographic fibers that selectively absorb and reflect light, the plurality of holographic fibers characterized as including a central core including one of a light transmitting material, a light absorbing material, a light reflecting material, and a polymer dispersed liquid crystal (PDLC) material and a plurality of layers of an optical media, each layer having differing indices of refraction thereby forming a multi-layer interference coating overcoating the central core, the plurality of layers of an optical media characterized as selectively reflecting particular wavelengths of light while transmitting differing wavelengths of light, thereby generating a plurality of interference patterns that form a holographic optical image as a result of an incident light.

25. A textile fabric as claimed in claim 24 wherein the polymer dispersed liquid crystal (PDLC) material is characterized as changing from transparent state to a diffuse state under the influence of a voltage.

* * * * *